United States Patent [19]

Haugsjaa et al.

[11] 4,001,632

[45] Jan. 4, 1977

[54] HIGH FREQUENCY EXCITED ELECTRODELESS LIGHT SOURCE

[75] Inventors: Paul Osborne Haugsjaa, Acton; Robert James Regan, Needham, both of Mass.

[73] Assignee: GTE Laboratories Incorporated, Waltham, Mass.

[22] Filed: Apr. 21, 1975

[21] Appl. No.: 570,113

[52] U.S. Cl. ..... 315/39; 240/103 R; 313/201; 313/228; 315/150; 315/248

[51] Int. Cl.[2] ..... H05B 41/24

[58] Field of Search ..... 315/39, 150, 155, 246, 315/248, 267; 313/113, 201, 217, 218, 220, 221, 228; 240/103 R

[56] References Cited

UNITED STATES PATENTS

| | | | |
|---|---|---|---|
| 2,974,243 | 3/1961 | Marrison | 313/201 X |
| 3,787,705 | 1/1974 | Bolin et al. | 315/267 X |
| 3,826,950 | 7/1974 | Hruda et al. | 315/267 |
| 3,873,884 | 3/1975 | Gabriel | 315/267 |

*Primary Examiner*—Siegfried H. Grimm
*Attorney, Agent, or Firm*—Irving M. Kriegsman; Leslie J. Hart

[57] ABSTRACT

A light source includes an electrodeless lamp having an envelope for enclosing a volatile fill material which emits light upon vaporization and excitation, a source of power at a high frequency and a termination fixture coupled to the source. The fixture has inner and outer conductors which have dimensions such that the lamp is located in the high field region at the end of the conductors. When the high frequency power is applied to the fixture, a voltage standing wave is formed which initiates vaporization and excitation of the fill material. The termination load impedance which is that of the lamp changes from a lossy open circuit to a finite value when vaporization and excitation occur. An impedance matching device is provided for matching the running lamp impedance to the output impedance of the source.

21 Claims, 3 Drawing Figures

HIGH FREQUENCY EXCITED ELECTRODELESS LIGHT SOURCE

CROSS REFERENCE TO RELATED APPLICATION

This application is related to U.S. Pat. application, Ser. No. 570,112 filed concurrently in the names of P. Haugsjaa, R. Regan and W. McNeill and assigned to the same assignee of the present patent application.

BACKGROUND OF THE INVENTION

The present invention relates to electrodeless light sources and, more particularly, to such sources which are excited by high frequency power, such as in the range of 100 MHz to 300 GHz.

There have been, historically, three basic methods of exciting discharges without electrodes. The first method uses the discharge as a lossy part of either the capacitance or inductance of a "tank" circuit. This method is used to advantage only at frequencies where the dimensions of the lamp are much smaller than the wavelength of excitation. Also, in this method, these are power losses due to radiation and shifts in frequency upon start-up. A second method of exciting electrodeless lamps with microwave power is to place the lamp in the path of radiation from a directional antenna. However, since free propagation of microwave power occurs, there is an inherent inefficiency and some of the power is scattered, thereby endangering persons in the area.

A third method uses a resonant cavity which contains the lamp, a frequency tuning stub and a device for matching the lamp-cavity impedance to that of the source and transmission line. Examples of devices according to this method may be found in "Microwave Discharge Cavities Operating at 2450 MHz" by F. C. Fehsenfeld et al, Review of Scientific Instruments, Volume 36, Number 3 (March, 1965). This publication describes several types of tunable cavities. In one type, cavity No. 5, the discharge cavity transfers power from the source to the lamp, and the resonant structure of the cavity increases the electric field in the gas of the lamp. The presence of a discharge in the resonator changes the resonant frequency and also changes the loaded Q factor. Therefore, it is necessary to provide both tuning (frequency) and matching (impedance) adjustments to obtain efficient operation over a wide range of discharge conditions. The tuning stub is first adjusted for a minimum reflected power with the minimum probe penetration. Next, the probe (impedance) is adjusted. Since these two operations are not independent, successive readjustments are required to achieve optimum efficiency.

All of these tunable cavities have features which make them less than ideally suited for use in an electrodeless light source. To make cavity type systems useful economically, the cavity must be small enough so that it would be feasible to use such systems in place of the conventional electrode containing lamp. Resonant cavities are too large and must be larger if lower microwave frequencies are used. One resonant cavity for 2450 MHz operation has four inches as its greatest dimension; the size would be even larger for operation at 915 MHz which is a standard microwave frequency for consumer use, such as with microwave ovens. Operation at this lower frequency is also advantageous from the view that the greater the frequency the more expensive the microwave power source becomes. The known tunable cavity has a less than optimum shape because the lamp is substantially enclosed by the resonant cavity housing, thereby impeding the transmission of light.

SUMMARY OF THE INVENTION

According to the present invention, an electrodeless light source is provided in which the problems previously mentioned have been overcome. More specifically, the light source has a fixture which forms an open circuit termination for the high frequency power from a source. The fixture has an inner conductor and an outer conductor disposed around the inner conductor. The fixture has dimensions such that the lamp may be located in the high field region at the ends of the inner and outer conductors. The lamp and the termination fixture form a lossy open circuit termination when high frequency power is first applied from the source, thereby forming a voltage standing wave with a maximum at the lamp. This wave initiates electrical breakdown of the lamp fill material. The initiation of electrical breakdown (i.e., vaporization, partial ionization, and excitation of the lamp fill material) results in a change in the lamp impedance from an infinite value to a finite value. To enable a maximum power transfer from the source to the lamp in the lamp running state, means are provided for matching the lamp impedance during the running state to the source impedance. In a preferred embodiment, the conductors have dimensions such that the characteristic impedance of the fixture is equal to the source impedance, and the matching means includes an adjustable impedance matching device disposed between the source and the fixture. The termination fixture of the present invention has a relatively compact size, even when excited by microwave frequencies which are lower than that used in the known resonant cavities. The fixture includes other desirable features which provide several other advantages, such as enhancing the transmission therefrom of the light from the lamp.

DESCRIPTION OF PREFERRED EMBODIMENTS

Figure 1:
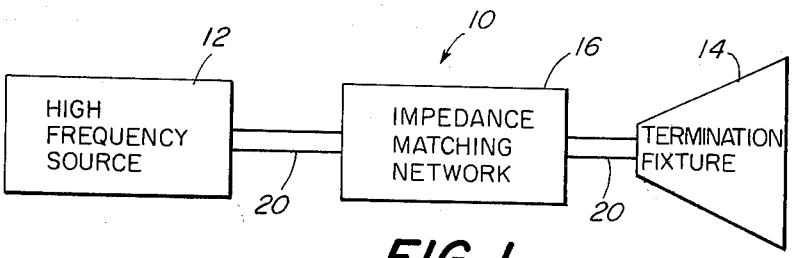
FIG. 1 is a block diagram of an improved light source according to the present invention.
Figure 2:
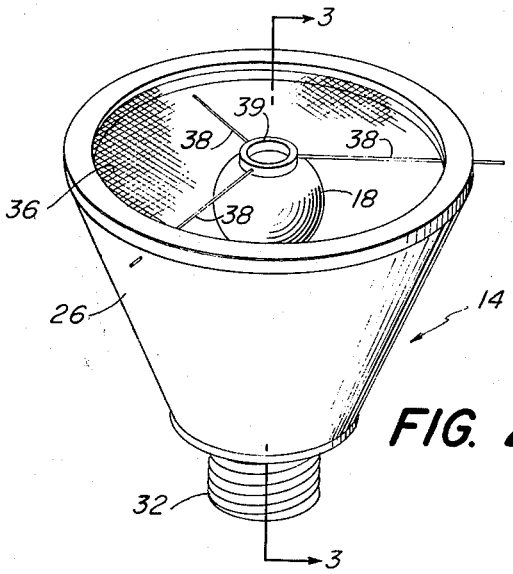
FIG. 2 is a perspective view of a termination fixture according to the present invention.
Figure 3:
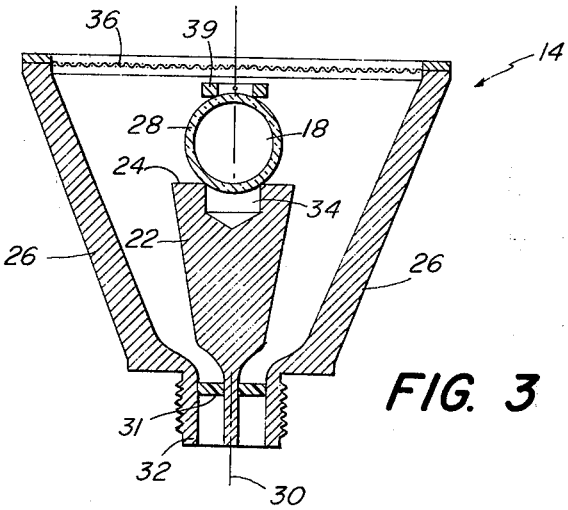
FIG. 3 is a sectional view of the fixture taken along lines A—A in FIG. 2.

In an exemplary embodiment of the present invention, as shown in FIG. 1, a light source, indicated generally by the reference numeral 10, comprises a source 12 of power at a high frequency, a termination fixture 14, and an electrodeless lamp 18, which is shown more clearly in FIGS. 2 and 3. The use of the language "high frequency" is intended to include frequencies ranging from about 100 MHz to about 300 GHz. Preferably, the frequency is in the microwave region, and when the light source is used in a commercial environment, the preferred microwave frequency is in the industrial scientific and medical (ISM) band ranging from 902 to 928 MHz. Several types of microwave power sources 12 may be used; for example, one commercially available source is an Airborne Instruments Laboratory Power Signal Source type 125. In FIG. 1, the source 12 was operated at a frequency of 915 MHz. The source 12 is coupled to the termination fixture 14. One technique for the provision of this coupling is to provide a coaxial cable 20. However, the invention is not intended to be limited by the particular type of coupling used.

Referring now to FIGS. 2 and 3, the termination fixture 14 includes an inner conductor 22 and an outer conductor 26 which is disposed around the inner conductor 22. The conductors have dimensions such that the lamp may be located within the high field region at the ends of the conductors. The electrodeless lamp 18 includes an envelope 28 which is made of a light transmitting material, such as quartz, and a volatile fill material (not shown) disposed within the envelope 28. The fill material emits light upon vaporization and excitation.

In operation, the fixture 14 and the lamp 18 form a lossy open circuit termination for the high frequency power when applied thereto to produce a voltage standing wave with a maximum at the lamp 18. This wave initiates breakdown of the fill material within the lamp 18. This standing wave is advantageous for starting excitation since the electric field is maximized in the lamp. After the lamp fill material becomes conducting, the fixture 14 is terminated in some impedance which is characteristic of the lamp 18 which is used.

In accordance with one preferred feature of the present invention, means are provided for matching the lamp running impedance to the source impedance to maximize the forward power transmitted to the lamp. One suitable means includes shaping the fixture conductors such that the characteristic impedance of the fixture matches the impedance of the source and providing an impedance matching network 16 between the source and the fixture. One type of impedance matching network 16 which may be used is a stub stretcher. One suitable stub stretcher, which is commercially available, is the model No. SL-03N manufactured by Microlab/FXR. For most lamps, the impedance matching network need only be set once for each type of lamp used in a termination fixture; for some lamps, however, it may be desirable to make several impedance matching settings before the lamp reaches the running state. If desired, a starting assist device (not shown) such as a UV source near the lamp may be used.

One feature of the form of the present invention illustrated in FIGS. 1 to 3 is that the characteristic impedance of the fixture is equal to the output impedance of the coupled microwave source 12. This is to insure impedance matching between the power source and the fixture. For example, in the preferred embodiment, the impedance of the source 12 is 50 ohms and the characteristic impedance of the cable is matched to that of the source. The impedance of the lamp fixture is matched to that of both the transmission line 20 and the source 12. In the preferred embodiment of the termination fixture, the conductors 22 and 26 are concentric with respect to each other, circular in cross-section, and the ratio of the outer diameter of the inner conductor 22 to the inner diameter of the outer conductor 26 is constant at each location along a longitudinal axis 30 of the fixture 14. The equation which relates the fixture characteristic impedance to the ratio of diameters of the termination fixture is:

$$Z = \frac{138}{\sqrt{\epsilon_r/\mu_r}} \log \frac{b}{a}$$

where $\epsilon_r$ = dielectric constant of the medium between the conductors $\mu_r$ = permeability of the medium between the conductors $b$ = inner diameter of the outer conductor $a$ = diameter of the inner conductor.

For the present embodiment in which the impedance of the fixture is 50 ohms, this ratio is equal to approximately 2·3. It should be understood that the source may have an impedance other than 50 ohms when desirable. In another feature of the fixture 14, the diameters of the inner and outer conductors 22 and 26, respectively, increase along the longitudinal axis 30 toward the direction of the lamp 18. This permits the fixture 14 and particularly the outer conductor 26 to form a conical housing for the lamp as illustrated in FIGS. 2 and 3. Also, preferably, the length of the outer conductor 26 projected along the longitudinal axis 30 is at least equal to the length of the inner conductor 22 plus the diameter of the lamp envelope 28. Thus, the outer conductor 26 forms an enclosure for the fixture except for the opening of the end of the outer conductor. The fixture 14 may also have an appropriate input connector 32 for coupling the inner and outer conductors 22 and 26, respectively, of the fixture 14 to either the respective conductors of the coaxial transmission line 20 or of the source 12. An element 31 is made of an insulating material and acts as a support.

There are several preferred features of the termination fixture 14 illustrated in FIGS. 2 and 3. First, in FIG. 3 the end 24 of the inner conductor 22 is formed with a central circular depressed region 34 having a maximum diameter which is less than that of the lamp. The lamp is disposed over the opening of the region 34, and this feature minimizes the transfer of heat from the lamp 18 to the inner conductor 22. This minimal transfer of heat is accomplished by the fact that the inner conductor and the lamp have minimal abutting surface areas. Preferably, the inner and outer conductors are plated with silver to reduce skin depth losses. The surfaces may also be polished to provide reflective surfaces for the light and thus enhance the intensity of illumination from this system. Also, a screen 36 which has a high optical transmission factor may be located over the opening in the outer conductor 26 to contain stray microwave radiation. One preferred screen 36 utilizes a 98% transmission nickel material and has a 20 wire per inch grid.

Preferably the fixture 14 includes a device for holding the lamp 18 in place on the end 24 of the inner conductor 22. This device may include a series of rods 38 connected to the outer conductor 26 and contacting the lamp 18 through an element 39 to secure the lamp between the inner conductor and the rod. Alternatively, the screen may serve as the holding device. The rods 38 may be made of any rigid material, such as stainless steel or quartz. The inner and outer conductors are made of brass.

The following are specific Examples of lamps and fill materials which may be used.

EXAMPLE I

Fill material
9.1 mg. of mercury
10 torr of argon
Envelope
Quartz sphere having a 15 mm ID

EXAMPLE II

Fill material
8.9 mg. of mercury
1.5 mg. of $ScI_3$
1.7 mg. NaI
20 torr of argon
Envelope
Quartz sphere having a 15 mm. ID

EXAMPLE III

Another fill material is 2 or 3 atoms of sodium for each mercury atom to yield under operating conditions 200 torr sodium partial pressure and about 1,000 torr mercury partial pressure. The envelope is a material which is resistant to sodium such as translucent $Al_2O_3$.

There are several advantages of the previously described light source over known microwave tunable cavity devices for creating light discharges. First, the design of the termination fixture is such that it is more suitably shaped for eventual use in a commercial environment. Secondly, the lamp may be used at relatively low microwave frequencies which may provide additional economic advantage. This is because the cost of power sources is usually related to the microwave frequency at which it is used. In known prior art systems, such as those operating at 2450 MHz, it is expected that the cost for this power source is greater than that for a source operating in the ISM band of 902 to 928 MHz. In addition, this particular frequency band, and particularly 915 MHz, is one that is presently used in commercial environments in which microwave devices, such as ovens, are used. Lastly, and perhaps more importantly, the termination fixture of the present invention eliminates the tedious tuning requirements which are present in known resonant cavities. In the present invention, an impedance matching adjustment is made for the lamp, whereas known tunable cavity devices require tuning two probes which are dependent upon each other.

In its broadest aspect, the present invention contemplates the idea of making an electrodeless lamp comprise the termination load for a device having an inner and outer conductor, the lamp being located in the high field region at the ends of the conductors.

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

We claim:

1. A light source including:

a. a source of power at a high frequency, b. an electrodeless lamp having an envelope made of a light transmitting material and a volatile fill material disposed within the envelope, the fill material emitting light upon vaporization, partial ionization and excitation, and c. a termination fixture coupled to the source, the fixture including an inner conductor and an outer conductor disposed around and insulated from the inner conductor, the conductors having dimensions such that the lamp may be located in the high field region at the ends of the inner and outer conductors to form a lossy open circuit termination for the high frequency power which when applied initiates breakdown, vaporization and excitation of the fill material within the lamp.

2. The light source according to claim 1 further including means for matching the lamp impedance during the running state to the source impedance to enable maximum power transfer from the source to the lamp.

3. The light source according to claim 2 wherein the conductors have dimensions such that the fixture has a characteristic impedance which is equal to the impedance of the power source and wherein the matching means includes an impedance matching network disposed between the source and the lamp for matching the running lamp impedance to the source impedance.

4. The light source according to claim 3 wherein the conductors are concentric and circular in cross-section and wherein the ratio of the outer diameter of the inner conductor to the inner diameter of the outer conductor is constant at each location along a longitudinal axis of the fixture.

5. The light source according to claim 4 further including a transmission line coupling high frequency power from the source to the fixture, the characteristic impedance of the fixture being equal to the characteristic impedance of the line.

6. The light source according to claim 5 wherein the characteristic impedance of the line is 50 ohms and the ratio of conductor diameters is approximately 2.3.

7. The light source according to claim 5 wherein the impedance matching network is a stub stretcher disposed along the transmission line.

8. The light source according to claim 1 wherein the inner and outer conductors are plated with a highly conductive metal to reduce skin depth losses.

9. The light source according to claim 8 wherein the plated conductors are polished to enhance the intensity of illumination from the fixture.

10. The light source according to claim 1 further including means for holding the lamp in place on the end of the inner conductor.

11. The light source according to claim 1 wherein the high frequency is within the ISM frequency bands.

12. The light source according to claim 11 wherein the frequency is 915 MHz.

13. The light source according to claim 1 wherein the fill material is adapted to produce a high pressure discharge upon excitation.

14. The light source according to claim 13 wherein the lamp fill material is mercury and argon and the envelope is spherical in shape and made of quartz.

15. A light source including:

a. a source of power at a high frequency, b. an electrodeless lamp having an envelope made of a light transmitting material and a volatile fill material disposed within the envelope, the fill material emitting light upon vaporization, partial ionization and excitation, and c. a termination fixture coupled to the source, the fixture including an inner conductor and an outer conductor disposed around the inner conductor, the conductors having dimensions such that the lamp may be located in the high field region at the ends of the inner and outer conductors to form a lossy open circuit termination for the high frequency power which when applied initiates breakdown, vaporization and excitation of the fill material within the lamp, the conductors having dimensions such that the fixture has a characteristic impedance which is equal to the impedance of the power source and being concentric and circular in cross-section, the ratio of the outer diameter of the inner conductor to the inner diameter of the outer conductor being constant at each location along a longitudinal axis of the fixture, the diameters of the inner and outer conductors increasing along the longitudinal axis in a direction toward the lamp, and d. means for matching the lamp impedance during the running state to the source impedance to enable maximum power transfer from the source to the lamp, the matching means including an impedance matching network disposed between the source and the lamp for matching the running lamp impedance to the source impedance.

16. The light source according to claim 15, wherein the length of the outer conductor projected along the longitudinal axis is at least equal to the length of the inner conductor plus the diameter of the lamp envelope.

17. A light source including:

a. a source of power at a high frequency, b. an electrodeless lamp having an envelope made of a light transmitting material and a volatile fill material disposed within the envelope, the fill material emitting light upon vaporization, partial ionization and excitation, and c. a termination fixture coupled to the source, the fixture including an inner conductor and an outer conductor disposed around the inner conductor, the conductors having dimensions such that the lamp may be located in the high field region at the ends of the inner and outer conductors to form a lossy open circuit termination for the high frequency power which when applied initiates breakdown, vaporization and excitation of the fill material within the lamp, the end of the inner conductor being formed with a central circular depressed region having a maximum diameter less than that of the lamp, the lamp being disposed over the opening of the region to minimize the transfer of heat from the lamp to the inner conductor.

18. A light source including:

a. a source of power at a high frequency, b. an electrodeless lamp having an envelope made of a light transmitting material and a volatile fill material disposed within the envelope, the fill material emitting light upon vaporization, partial ionization and excitation, and c. a termination fixture coupled to the source, the fixture including an inner conductor and an outer conductor disposed around the inner conductor, the conductors having dimensions such that the lamp may be located in the high field region at the ends of the inner and outer conductors to form a lossy open circuit termination for the high frequency power which when applied initiates breakdown, vaporization and excitation of the fill material within the lamp, and d. a metallic screen being made of a highly conducting material and having a high optical transmission factor located over the opening in the outer conductor to contain stray radiation.

19. The light source according to claim 18 wherein the screen is in contact with the lamp to secure the lamp in place at the end of the inner conductor.

20. A light source including:

a. a source of power at a high frequency, b. an electrodeless lamp having an envelope made of a light transmitting material and a volatile fill material disposed within the envelope, the fill material emitting light upon vaporization, partial ionization and excitation, and c. a termination fixture coupled to the source, the fixture including an inner conductor and an outer conductor disposed around the inner conductor, the conductors having dimensions such that the lamp may be located in the high field region at the ends of the inner and outer conductors to form a lossy open circuit termination for the high frequency power which when applied initiates breakdown, vaporization and excitation of the fill material within the lamp, and d. means for holding the lamp in place on the end of the inner conductor, the lamp holding means including at least one rod connected to the outer conductor and contacting the lamp to secure the lamp between the inner conductor and the rod.

21. The light source according to claim 20 wherein the rod is stainless steel and the conductors are brass.

* * * * *